US006808210B1

(12) United States Patent
Harrison et al.

(10) Patent No.: US 6,808,210 B1
(45) **Date of Patent: *Oct. 26, 2004**

(54) DRILL PIPE WITH UPSET ENDS HAVING CONSTANT WALL THICKNESS AND METHOD FOR MAKING SAME

(75) Inventors: Gregory T. Harrison, Stillwater, OK (US); James L. Carothers, Perry, OK (US); George A. Mitchell, Poland, OH (US); Paul F. Russo, New Castle, PA (US)

(73) Assignee: The Charles Machine Works, Inc., Perry, OK (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 418 days.

(21) Appl. No.: 08/923,380

(22) Filed: Sep. 3, 1997

(51) Int. Cl.[7] ..... F16L 13/02
(52) U.S. Cl. ..... 285/288.1; 138/109; 403/343
(58) Field of Search ..... 285/288.1, 333, 285/334; 138/109; 403/343

(56) References Cited

U.S. PATENT DOCUMENTS

| | | | | |
|---|---|---|---|---|
| 1,236,145 A | * | 8/1917 | Burns | 285/288.1 X |
| 1,670,532 A | | 5/1928 | Crawford | |
| 1,714,818 A | * | 5/1929 | Reed | 403/343 X |
| 1,810,091 A | * | 6/1931 | Siegle | |
| 2,190,362 A | * | 2/1940 | Keener | 285/288.1 |
| 2,211,173 A | * | 8/1940 | Shaffer | |
| 2,239,826 A | * | 4/1941 | Neuhaus | |
| 2,239,942 A | | 4/1941 | Stone et al. | 285/146 |
| 2,259,232 A | * | 10/1941 | Stone | |
| 2,855,224 A | * | 10/1958 | Boice | 285/288.1 X |

(List continued on next page.)

FOREIGN PATENT DOCUMENTS

| | | | |
|---|---|---|---|
| EP | 0386372 | 9/1990 | E21B/17/042 |
| GB | 1000955 | 8/1965 | E21B/17/00 |
| WO | 9517575 | 6/1995 | E21B/17/00 |

OTHER PUBLICATIONS

Article by Paul F. Russo entitled Uniquie Innovations in Cold Forming Technology dated Dec. 4, 1991.
Article by Paul F. Russo entitled Unique Innovations in Cold Forming Technology dated Dec. 4, 1991.

*Primary Examiner*—Alison Pickard
*Assistant Examiner*—Vishal Patel
(74) *Attorney, Agent, or Firm*—McKinney & Stringer, P.C.

(57) ABSTRACT

A drill pipe with cold upset ends. The drill pipe includes an elongate tubular portion with a pin joint on one end and a box joint on the other end. Each of the ends of the tubular portion is expanded using a cold upsetting process to provide a transitional portion and a joint receiving portion. The ends of the tubular portion have an inner and outer diameter which is greater than the inner and outer diameter of the tubular portion. The wall thickness of the tubular portion is substantially the same throughout its entire length, including the transitional portions and the joint receiving portions. A drill pipe made in accordance with this invention is durable and less costly to manufacture.

A cold upsetting method by which the drill pipe is made utilizes no external heat. An internal mandrel is first inserted hydraulically into the ends of a tubular steel shaft to enlarge the ends. Then, an external "wipe over" die is applied to conform the wall of the ends being expanded to the shape of the internal mandrel. The pipe thus produced has a substantially uniform wall thickness.

14 Claims, 2 Drawing Sheets

U.S. PATENT DOCUMENTS

| | | | | | |
|---|---|---|---|---|---|
| 3,304,762 | A | | 2/1967 | Skinner | 72/479 |
| 3,326,581 | A | | 6/1967 | Wong | 285/173 |
| 3,648,500 | A | | 3/1972 | Vaill | 72/71 |
| 3,789,648 | A | | 2/1974 | Ames | 72/316 |
| 4,192,167 | A | | 3/1980 | Huebner et al. | 72/356 |
| 4,211,103 | A | | 7/1980 | Grimaldo | 72/316 |
| 4,256,518 | A | | 3/1981 | Bolton et al. | 148/127 |
| RE31,123 | E | * | 1/1983 | Simmons | 285/334 |
| 4,416,476 | A | * | 11/1983 | Garrett | 285/288.1 |
| 4,452,063 | A | | 6/1984 | Sebastiani et al. | 72/356 |
| 4,454,745 | A | | 6/1984 | Cudini | 72/370 |
| 4,465,422 | A | | 8/1984 | Blust, Sr. et al. | 414/433 |
| 4,487,357 | A | | 12/1984 | Simon | 228/173 |
| 4,606,212 | A | | 8/1986 | Sunaga et al. | 72/283 |
| 4,649,728 | A | | 3/1987 | LaCount et al. | 72/85 |
| 4,726,211 | A | | 2/1988 | Sunaga et al. | 72/283 |
| 4,747,431 | A | | 5/1988 | LaCount et al. | 138/109 |
| 4,845,972 | A | | 7/1989 | Takeuchi et al. | 72/370 |
| 5,119,662 | A | | 6/1992 | Sunaga et al. | 72/283 |
| 5,129,246 | A | | 7/1992 | Strickland et al. | 72/21 |
| 5,184,495 | A | | 2/1993 | Chunn et al. | 72/318 |
| 5,286,069 | A | * | 2/1994 | Wilson | 285/288.1 X |
| 5,361,846 | A | | 11/1994 | Carlin et al. | 166/380 |
| 5,379,625 | A | | 1/1995 | Hale | 72/318 |
| 5,517,843 | A | | 5/1996 | Winship | 72/306 |
| 5,637,042 | A | | 6/1997 | Breese | 464/183 |
| 5,643,093 | A | | 7/1997 | Breese | 464/183 |

* cited by examiner

DRILL PIPE WITH UPSET ENDS HAVING CONSTANT WALL THICKNESS AND METHOD FOR MAKING SAME

FIELD OF THE INVENTION

The present invention relates to drill pipes for horizontal underground boring operations and to methods for making such drill pipe.

SUMMARY OF THE INVENTION

The present invention is directed first to a drill pipe comprising a tubular steel shaft with expanded ends. One end of the shaft comprises a box joint receiving portion extending from a first transitional portion which in turn extends from the shaft. The other end of the shaft comprises a pin joint receiving portion extending from a second transitional portion.

The diameter of the pin joint receiving portion and the box joint receiving portion is greater than the diameter of the tubular portion, and the diameter of each of the transitional portions expands from the diameter of the tubular portion to the diameter of the adjacent joint receiving portion. The wall thickness of the shaft is substantially the same throughout its entire length including the tubular portion, the first and second transitional portions and the joint receiving portions. The drill pipe may include a pin joint and a box joint attached to the pin joint receiving portion and the box joint receiving portion, respectively.

Still further, the present invention is directed to a method for forming a drill pipe. In accordance with this method, both ends of a length of tubular steel are expanded using a cold upsetting process. In a preferred embodiment of this method, the shaft first is stabilized. Then an internal mandrel is forced into one end of the shaft a distance equal to the portion of the end that is to be expanded so that the inner diameter of the end is enlarged. Next, an external die is applied over the end while the internal mandrel still is in place so that the end is conformed externally to the shape of the internal mandrel. The process is repeated for the other end.

DETAILED DESCRIPTION OF THE PREFERRED EMBODIMENT

Horizontal underground boring operations using a steerable, jacking type system require the use of a drill string comprised of a number of drill pipe units. Each unit of drill pipe is provided with a pin end and a box end for end to end connection to each other to form the drill string. As the drilling operation proceeds, pipe units are added or "made up" one by one to extend the length of the drill string. When the boring process is completed, or the drill string needs to be withdrawn for some other purpose, the units of drill pipe are removed one by one or "broken out" until the drill string is completely disassembled.

The drill pipe utilized in these guided boring operations must be rigid enough to transmit torque, yet flexible enough to negotiate gradual turns as the direction of the bore hole changes. Generally, the flexibility of the drill pipe increases as the diameter of the pipe decreases. So, to improve flexibility, a smaller diameter pipe is preferred.

However, given the high working stresses at work in these operations, it is also true that as the diameter of the weld areas on the ends of the drill pipe decreases, the failure rate in these weld areas increases. Thus, larger weld diameters will increase the life of the drill pipe.

To reduce likelihood of failure in the weld area and yet provide good flexibility, current manufacturing methods include upsetting or expanding the ends of the shaft of the drill pipe by hot forging techniques so larger diameter pin and box joints can be attached The use of larger joints attached to the upset ends of smaller tubing has provided a durable drill pipe. However, the heat forging process typically used for deforming the ends of the drill pipe is time consuming and expensive because it requires high heat and multiple operations.

Accordingly there is a need for a simpler and more economical method for upsetting the ends of the drill pipe shaft. The present invention meets this need by providing a method for making drill pipe for use in horizontal boring operations utilizing a cold upsetting process for expanding the ends of tubular steel pipe. By eliminating the use of heat, the cold upsetting process of this invention makes the manufacturing process simpler, faster and therefore less expensive. Further, in the cold upsetting process of this invention there is no significant loss of wall thickness, rather this method produces a shaft having a substantially uniform wall thickness along its entire length, including the upset ends which receive the pin and box joints, and the tapered transitional portions between the upset ends and the straight tubular portion. It should be noted that while this invention has been described herein as applied to horizontal boring operations, the invention may be applied equally to other types of drill pipe such as for vertical drilling operations.

Figure 1:
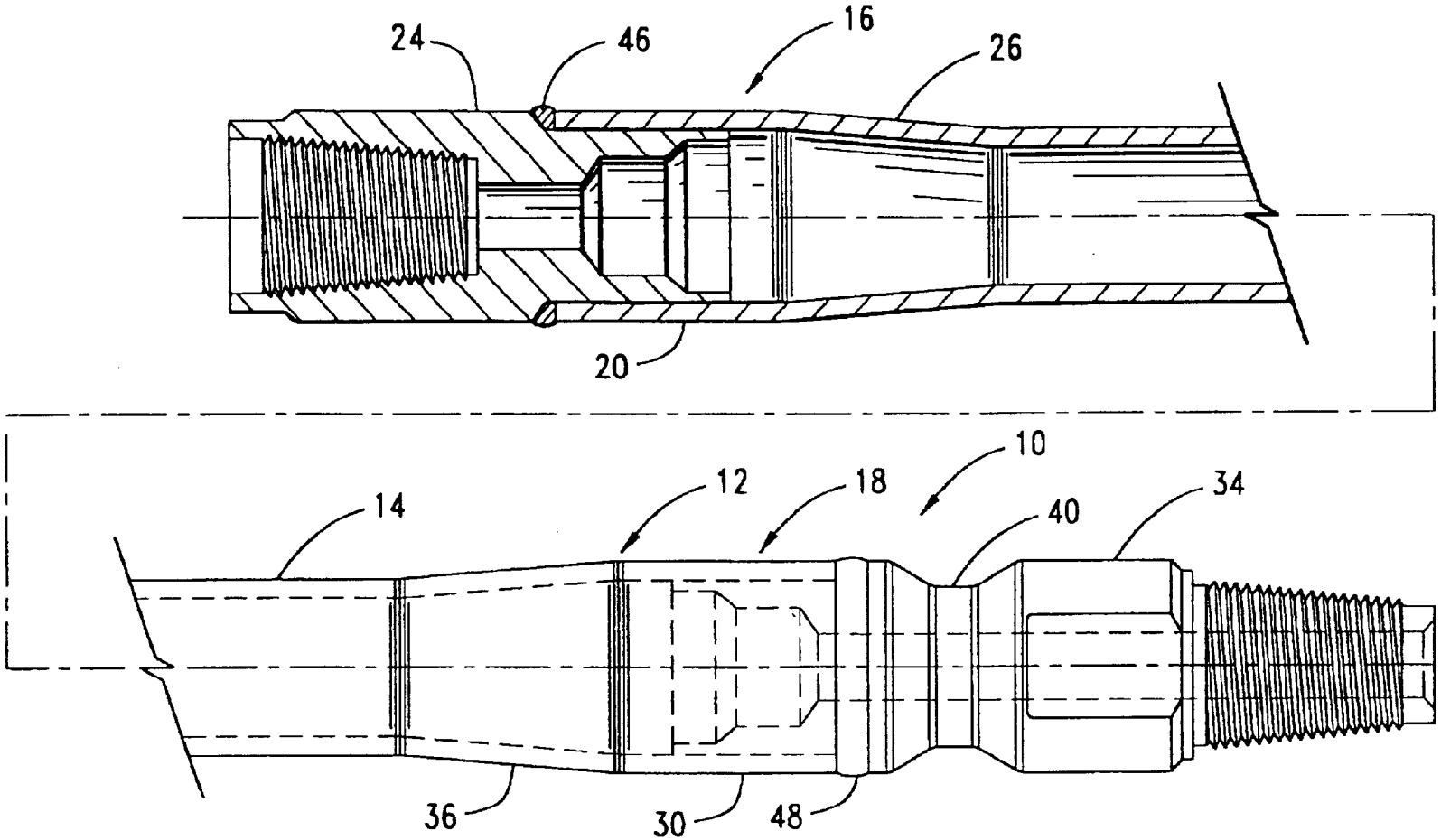
FIG. 1 shows a side elevational, partly fragmented, partly sectional view of a drill pipe, including the pin and box joints welded thereto, made in accordance with the present invention.
Figure 2:
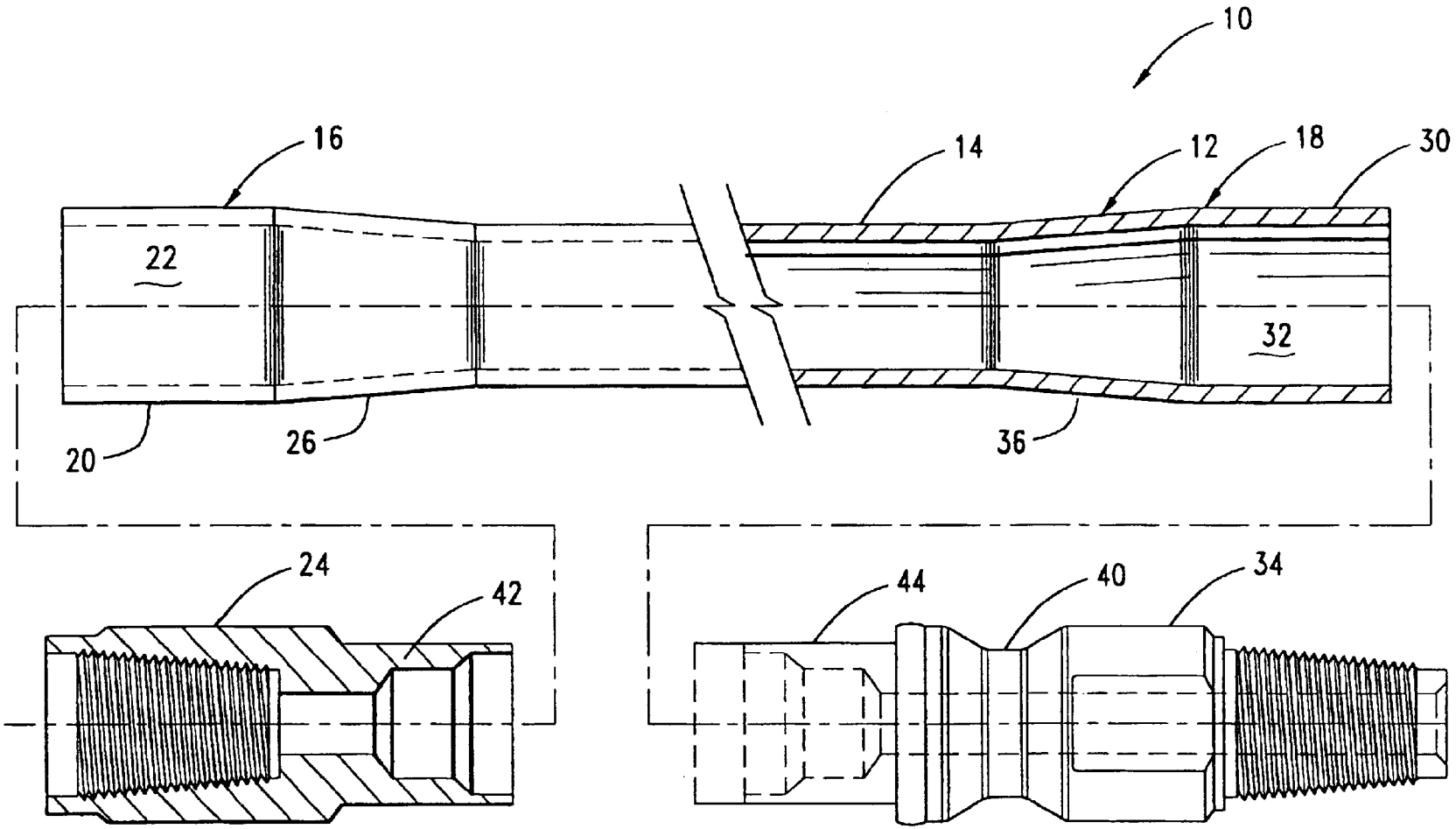
FIG. 2 shows a side elevational, partly fragmented, partly sectional view of the drill pipe of FIG. 1, showing the pin joint, the box joint and the shaft in exploded form.

With reference now to the drawings in general and to FIGS. 1 and 2 in particular, shown therein is a drill pipe constructed in accordance with the present invention. The drill pipe is designated generally by the reference numeral 10. The drill pipe 10 comprises a tubular steel shaft 12 which has an elongate tubular portion 14 terminating in a first end 16 and a second end 18.

The first end 16 of the shaft 12 comprises a box joint receiving portion 20 having an opening 22 (FIG. 2) adapted to receive a box joint 24 in a manner yet to be described. The first end 16 further comprises a first transitional portion 26 extending from the tubular portion 14 of the shaft 12 to the box receiving portion 20.

The second end 18 of the shaft 12 comprises a pin joint receiving portion 30 having an opening 32 (FIG. 2) adapted to receive a pin joint 34, as will be described hereafter. The second end 18 further comprises a second transitional portion 36 extending from the tubular portion 14 to the pin joint receiving portion 30.

As seen best in FIG. 2, the diameters of the box and pin joint receiving portions 20 and 30 preferably are about the same, and this dimension is greater than the diameter of the elongate tubular portion 14 therebetween. Thus, the shape of the intervening first and second transitional portions 26 and 36 is generally frusto-conical or tapered. Each transitional portion 26 and 36 expands from the diameter of the tubular portion 14 to the diameter of the adjacent joint receiving portions 20 and 30.

The wall thickness of the shaft 12 is substantially the same through its entire length, including the tubular portion 14, the first and second transitional portions 26 and 36 and the adjoining joint receiving portions 20 and 30. This is due to the cold upsetting process used in the method of the present invention which now will be described.

In accordance with the method of the present invention a tubular steel shaft first is selected. The steel shaft is selected to provide the desired length and diameter of the finished drill pipe.

Next the ends of the steel shaft are expanded using a cold upsetting process. First, the steel shaft is stabilized. Preferably, the shaft will be secured by an external clamp applied along the middle portion somewhere between the ends of the shaft to be expanded. Once the shaft is securely clamped in position, an internal mandrel is inserted into the first end of the shaft. The mandrel is forced into the end under sufficient pressure to deform and enlarge the end. In the preferred practice of this invention, a hydraulic system is used to force the mandrel into the shaft. The mandrel is forced into the end of the shaft a distance equal to the portion of the end to be expanded. This operation will enlarge the inner diameter of the end of the shaft, but the wall of the expanded portion may not conform well to the shape of the internal mandrel.

To cause the wall of the expanded portion of the shaft surrounding the internal mandrel to better conform shape of the mandrel, an external die may be applied to the first end while the mandrel is held in place inside. This application process preferably is carried out by sliding the die from the behind the expansion area up over the enlarged end. This "wipe over" process will press out the wall of the enlarged end so that the end has a substantially uniform wall thickness which is substantially the same as the wall thickness of the original shaft. The thickness of the expanded portion of the shaft may be slightly less than the original wall thickness, but in most instances the expanded portion will lose less than about 10 to 15 percent in thickness.

Thus, the shaft 12 of the drill pipe 10 of this invention preferably is integrally formed. That is, the shaft is formed from a single piece of tubular steel, to provide the drill pipe shown in FIGS. 1 and 2, having the elongate tubular portion 14, first and second transitional portions 26 and 36 and the adjacent box and pin joint receiving portions 20 and 30.

Having formed the shaft 12, the box and pin joints 24 and 34 are attached to the first and second ends 16 and 18, respectively, of the shaft 12. Pin and box joints of any desired configuration may be used, the particular joints shown herein being merely exemplary. A groove 40 may be provided on the pin joint to facilitate making up and breaking out the units of pipe during the boring operation.

In accordance with known procedures, the stubs 42 and 44 (FIG. 2) of the box and pin joints 24 and 34 are pressed into the openings 22 and 32 of the first and second ends 20 and 30. Then the joints 24 and 34 are attached to the shaft 14 such as by welding, threading, press fitting, shrink fitting or adhesive bonding or any combination thereof. Preferably, the joints 24 and 34 are arc welded at 46 and 48 (FIG. 1) to permanently attach the joints to the shaft 14.

Changes may be made in the combination and arrangement of the various parts, elements, steps and procedures described herein without departing from the spirit and scope of the invention as defined in the following claims.

What is claimed is:

1. A drill pipe comprising:

a tubular shaft comprising an elongate tubular portion and terminating in a first end and a second end;

wherein the first end of the shaft comprises:

a cylindrical box joint receiving portion having an opening adapted to receive a box joint; and a first transitional portion extending from the tubular portion of the shaft to the box joint receiving portion;

wherein the second end of the shaft comprises:

a cylindrical pin joint receiving portion having an opening adapted to receive a pin joint; and a second transitional portion extending from the tubular portion of the shaft to the pin joint receiving portion;

wherein the diameters of the pin joint receiving portion and the box joint receiving portion are greater than the diameter of the tubular portion;

wherein the diameter of the first transitional portion expands along a first transitional portion distance from the tubular portion to the box joint receiving portion;

wherein the diameter of the second transitional portion expands along a second transitional portion distance from the tubular portion to the pin joint receiving portion;

wherein the transitional portion distances are each greater than the radius of the tubular portion; and wherein the wall thickness of the shaft is substantially the same throughout the length of the tubular portion, the first and second transitional portions, and the pin and box joint receiving portions.

2. The drill pipe of claim 1 further comprising a pin joint attached to the pin joint receiving portion and a box joint attached to the box joint receiving portion.

3. The drill pipe of claim 2 wherein the pin and box joints are attached by welding.

4. The drill pipe of claim 1 wherein the shaft is integrally formed.

5. A drill pipe comprising:

a tubular shaft comprising an elongate tubular portion terminating in a first end and a second end;

wherein the first end of the shaft comprises:

a box joint receiving portion having a cylindrical box joint opening; and a first transitional portion extending from the tubular portion of the shaft to the box joint receiving portion;

wherein the second end of the tube comprises:

a pin joint receiving portion having a cylindrical pin joint opening; and a second transitional portion extending from the tubular portion of the shaft to the pin joint receiving portion;

a box joint having a stub portion receivingly disposed within the box joint opening and a first surface of the box joint adjacent a second surface of the box joint receiving portion, the first and second surfaces forming a first groove;

a weld filler material in the first groove joining only the box joint to only the box joint receiving portion in attaching the box joint to the first end of the shaft;

a pin joint having a stub portion receivingly disposed within the pin joint opening and a third surface of the pin joint adjacent a fourth surface of the pin joint receiving portion, the third and fourth surfaces forming a second groove;

a weld filler material in the second groove joining only the pin joint to only the pin joint receiving portion in attaching the pin joint to the second end of the shaft;

wherein the diameters of the pin joint receiving portion and the box joint receiving portion are greater than the diameter of the tubular portion;

wherein the diameter of the first transitional portion expands from the tubular portion to the box joint receiving portion;

wherein the diameter of the second transitional portion expands from the tubular portion to the pin joint receiving portion; and wherein the wall thickness of the shaft is substantially the same throughout the length of the tubular portion, the first and second transitional portions, and the pin and box joint receiving portions.

6. A method for making a drill pipe comprising the step of:

expanding both ends of a tubular steel shaft using a cold upsetting process to produce a shaft with an elongate tubular portion, a first expanded end, and a second expanded end;

wherein the first end of the shaft comprises:

a cylindrical box joint receiving portion having an opening adapted to receive a box joint; and a first transitional portion extending from the tubular portion of the shaft to the box joint receiving portion;

wherein the second end of the shaft comprises;

a cylindrical pin joint receiving portion having an opening adapted to receive a pin joint; and a second transitional portion extending from the tubular portion of the shaft to the pin joint receiving portion;

wherein the diameter of the pin joint receiving portion and the box joint receiving portion is greater than the diameter of the tubular portion;

wherein the diameter of the first transitional portion expands along a first transitional portion distance from the tubular portion to the box joint receiving portion;

wherein the diameter of the second transitional portion expands along a second transitional portion distance from the tubular portion to the pin joint receiving portion; and wherein the transitional portion distances are each greater than the radius of the tubular portion;

wherein the wall thickness of the shaft is substantially the same throughout the length of the tubular portion, the first and second transitional portions, and the pin and box joint receiving portions.

7. The method of claim 6 wherein the cold upsetting process comprises the steps of:

stabilizing the length of steel shaft;

forcing an internal mandrel into a first end of the steel shaft a distance from the first end equal to the length of the portion of the first end to be expanded, whereby the inner diameter of the first end is enlarged; and forcing an internal mandrel into a second end of the steel shaft a distance from the second end equal to the length of the portion of the second end to be expanded, whereby the inner diameter of the second end is enlarged.

8. The method of claim 7 further comprising the steps of:

applying an external die over the first end while the internal mandrel still is inside the first end to conform the first end externally to the shape of the internal mandrel; and applying an external die over the second end while the internal mandrel still is inside the first end to conform the second end externally to the shape of the internal mandrel.

9. The method of claim 7 wherein stabilizing the steel shaft is carried out using an external clamp between the first and second ends of the steel shaft.

10. The method of claim 7 wherein the steps of inserting the mandrel into the first and second ends is carried out hydraulically.

11. The method of claim 7 wherein the external die is applied to the first and second ends by moving the die over the first and second ends.

12. The method of claim 11 wherein the external die is applied to the first and second ends by sliding the die lengthwise over the first and second ends beginning from a point behind the expanded portion of the shaft.

13. The method of claim 7 further comprising the steps of:

after expanding the ends of the length of tubular steel shaft, attaching a box joint to the first end and attaching pin joint to the second end.

14. The method of claim 13 wherein the pin and box joints are attached by welding.

* * * * *